United States Patent [19]

Yan

[11] Patent Number: 4,935,690

[45] Date of Patent: Jun. 19, 1990

[54] CMOS COMPATIBLE BANDGAP VOLTAGE REFERENCE

[75] Inventor: Raymond C. Yan, Daly City, Calif.

[73] Assignee: Teledyne Industries, Inc., Mountain View, Calif.

[21] Appl. No.: 405,075

[22] Filed: Sep. 7, 1989

Related U.S. Application Data

[63] Continuation of Ser. No. 264,630, Oct. 31, 1988, abandoned.

[51] Int. Cl.[5] ..... G05F 3/20

[52] U.S. Cl. ..... 323/314; 323/907

[58] Field of Search ..... 323/311, 312, 313, 314, 323/315, 316, 907

[56] References Cited

U.S. PATENT DOCUMENTS 4,347,476 8/1982 Tam ..... 323/313

4,588,941 5/1986 Kerth et al. ..... 323/907

4,629,972 12/1986 Briner et al. ..... 323/314

4,769,589 9/1988 Rosenthal ..... 323/313

4,780,624 10/1988 Nicollini et al. ..... 323/314

4,788,455 11/1988 Mori et al. ..... 323/314

*Primary Examiner*—Peter S. Wong

*Attorney, Agent, or Firm*—Fliesler, Dubb, Meyer & Lovejoy

[57] ABSTRACT

In a circuit for providing a bandgap voltage reference, a first current proportional to the thermal voltage $V_T$ is generated by a first current source. By means of current mirror operation, the first current induces a second current source to generate a proportional second current. The second current source is coupled to means which generates a first voltage which is proportional to the base-emitter junction of a bipolar transistor. The second current generates a second voltage which is then added to the first voltage to give the voltage reference.

26 Claims, 3 Drawing Sheets

CMOS COMPATIBLE BANDGAP VOLTAGE REFERENCE

This application is a continuation of application Ser. No. 264,630, filed Oct. 31, 1988, now abandoned.

FIELD OF THE INVENTION

The present invention generally relates to a bandgap voltage reference. More particularly, the present invention relates to a CMOS bandgap voltage reference circuit capable of providing a bandgap voltage reference with respect to ground.

BACKGROUND OF THE INVENTION

The accurate operation of many integrated circuits, such as analog-to-digital converters, depends upon the ability of these circuits to reference a constant voltage. Therefore, any factors affecting the stability of the reference voltage would have an adverse effect upon the proper operation of these circuits. Since temperature variations are a common cause of voltage fluctuations in electrical circuits, there is therefore a need for a circuit that provides a substantially temperature-stable reference voltage.

The temperature stability of a bandgap reference voltage is commonly known in the art. A discussion of bandgap reference voltage circuits is found in "Analysis and Design of Analog Integrated Circuits" by P. R. Gray et al, John Wiley & Sons, 1977, at pages 254–261. Basically, a bandgap reference voltage, $V_{REF}$, is provided by a weighted sum, $V_{REF}=aV_{BE}+bV_T$, where $V_{BE}$ is the base-emitter junction voltage of a bipolar junction transistor, and $V_T$ is the thermal voltage kT/q. Typically, $V_T$ is obtained from the difference, $\Delta V_{BE}$, between the base-emitter junction voltages of two bipolar transistors. Because the temperature coefficients of $V_{BE}$ and $V_T$ have opposite signs, therefore, with proper weighting factors a and b, the sum $aV_{BE}+bV_T$, or the sum $aV_{BE}+c\Delta V_{BE}$, can theoretically be adjusted to have a zero temperature coefficient.

Due to the increasing use of CMOS integrated circuits, there has been a desire for a bandgap reference voltage circuit formed by CMOS processes. One such CMOS bandgap reference voltage circuit is disclosed in U.S. Pat. No. 4,588,941, issued to D. A. KERTH on May 13, 1986. Another CMOS bandgap voltage reference circuit is described in "Precision Curvature—Compensated CMOS bandgap reference" by B. Song et al in IEEE Journal of Solid State Circuits, Volume SC-18 No. 6, December 1983, pages 634–643.

The CMOS bandgap reference voltage circuits disclosed by the above-cited references are considered undesirable for several reasons. One of the disadvantages of these prior art circuits is their use of operational amplifiers, which usually increase the complexity and, as a result, the die size, of the circuits. Thus, one object of this invention is to have a circuit whereby a bandgap reference voltage is provided without the use of operational amplifiers.

Also, when implemented by P-well CMOS technology, the prior art circuits typically provide the reference voltage with respect to a power supply voltage (for example, $V_{DD}$) rather than with respect to ground. Because power supply voltages are more susceptible to noise, therefore another object of this invention is to have a CMOS circuit whereby the bandgap reference voltage can be provided with respect to ground.

SUMMARY OF THE INVENTION

The above identified objects are satisfied by the bandgap voltage reference circuit of the present invention which comprises a first current source and a second current source. The first current source operates independently of the second current source to generate a first current whose temperature coefficient is proportional to that of the difference, $\Delta V_{BE}$, between the junction voltages of two bipolar junction transistors. By means of current mirror operation, the first current induces a second current source to generate a second current proportional to the first current. As a result, the temperature coefficient of the second current is also proportional to that of $\Delta V_{BE}$. The second current passes through means whereby a proportional first voltage is generated. Thus, the temperature coefficient of the first voltage is also proportional to that of $\Delta V_{BE}$. The second current source is coupled to means for providing a second voltage whose temperature coefficient is proportional to $V_{BE}$. The first voltage and the second voltage are then summed to give a reference voltage.

Because the first voltage is generated from a current source, it can be easily made to reference ground potential.

As illustrated in the preferred embodiment of the present invention, the bandgap reference voltage is generated in accordance with the present invention without the use of operational amplifiers, therefore, the complexity of the circuit is greatly reduced.

These and other attendant advantages of the present invention will become apparent from the following detailed description of the preferred embodiment and by reference to the accompanying drawings.

DETAILED DESCRIPTION OF THE PREFERRED EMBODIMENT

Figure 1:
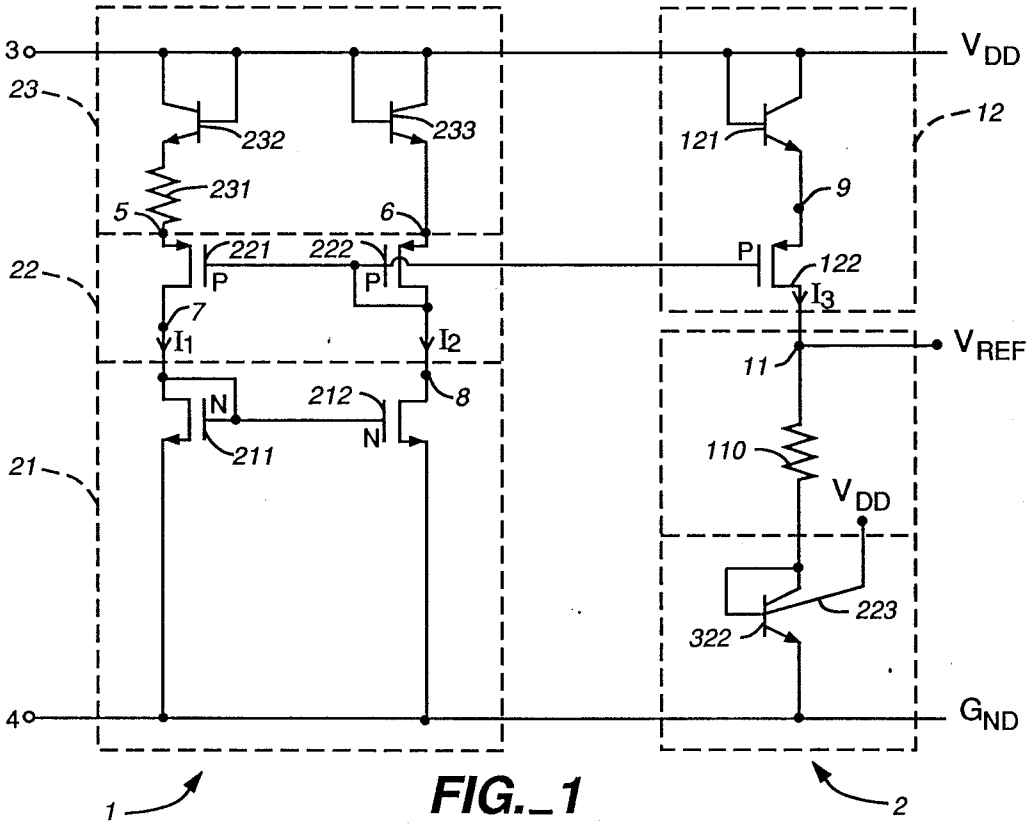
FIG. 1 is a schematic circuit diagram illustrating an embodiment of the present invention.

FIG. 1 is a schematic circuit diagram of a circuit embodying the present invention. FIG. 1 shows a block 1 which comprises a first current path $I_1$ coupled to a second current path $I_2$. A general understanding of the operation of current paths $I_1$ and $I_3$ can be obtained by referring to the current source circuit described in an application entitled "Resistorless, Precision Current Source", Ser. No. 037,867, filed April 13, 1987 by the same inventor and assigned to the assignee of the present application The application is incorporated herein by reference.

Basically, current paths $I_1$ and $I_2$ are coupled to a first stage 21, a second stage 22, and a third stage 23.

The first stage 21 is formed by two N-channel FETs 211, 212 connected to provide a current mirror operation between the current paths $I_1$ and $I_2$. Specifically, the gates of FETs 211 and 212 are connected in common to the drain of FET 211. The sources of FETs 211 and 212 are connected in common to the ground (GND) 4. The current mirror operation of the first stage 21 defines a constant ratio between the current $I_1$ and the current $I_2$ that $I_2$ equals $mI_1$. The ratio, m, between $I_1$ and $I_2$ is defined by the relative width-to-length dimensions between the channel regions of the FETs 211 and 212.

The second stage 22 operates interdependently with the first stage 21. The second stage 22 comprises two P-channel FETs 221, 222. The gates of FETs 221 and 222 are connected in common to the drain of FET 222. The drain of FET 222 is connected to the drain of FET 212. The drain of FET 221 is connected to the drain of FET 211. The second stage 22 establishes the relative potential between a node 5, at the source terminal of FET 221, in current path $I_1$ and a node 6, at the source terminal of FET 222, in current path $I_2$. Given a ratio between $I_1$ and $I_2$ as defined by the first stage 21, the width-to-length dimensions of the channel regions in FETs 221, 222 are adjusted so that the potential at node 5 is equal to the potential at node 6.

The third stage 23 comprises two NPN bipolar transistors 232, 233 and a resistor 231. The collectors and the bases of the bipolar junction transistors 232, 233 are commonly connected to the power supply terminal $V_{DD}$ 3. The emitter of bipolar junction transistor 232 is connected to one end of the resistor 231. The other end of resistor 231 is connected to the source of FET 221. The emitter of bipolar junction transistor 233 is connected to the source of FET 222.

Since the combined operation of stage 1 and stage 2 establishes equal potentials between the sources of FET 221 (node 5) and FET 222 (node 6), the potential difference between $V_{DD}$ and node 5 is equal to the potential difference between $V_{DD}$ and node 6. But the potential difference between $V_{DD}$ and node 5 is equal to the base-emitter junction voltage of transistor 232 plus the voltage drop across resistor 231, and the potential difference between $V_{DD}$ and node 6 is equal to the base-emitter junction voltage of transistor 233. Therefore:

$$V_{BE(233)}=V_{BE(232)}+I_1R_{231}$$

$$V_{BE(233)}-V_{BE(232)}=I_2R_{231}$$

$$\Delta V_{BE}=I_1R_{231}$$

$$I_1=\Delta V_{BE}/R_{231} \qquad \text{Eq. (1)}$$

Because, as previously discussed, FETs 211 and 212 operate to maintain $I_2=mI_1$, therefore, by substituting Eq. (1) into $I_1$:

$$I_2=m(\Delta V_{BE})/R_{231} \qquad \text{Eq. (2)}$$

Thus, the third stage 23 operates to establish the current value of $I_1$ so that it is proportional to the difference between the base-to-emitter voltages of the two bipolar junction transistors 232, 233. The temperature coefficient of $I_1$ in Eq. (2) is dependent upon the temperature coefficients of $R_{231}$ and $\Delta V_{BE}$.

The circuit of FIG. 1 also shows a second current source 2 having a current path $I_3$ which comprises a diode-connected NPN bipolar junction transistor 121 and a P-channel FET 122. The base and collector of transistor 121 are commonly connected to the power supply terminal 3. The emitter of transistor 121 is connected to the source of FET 122.

The gate of FET 122 is connected to the gates of FETs 221 and 222. The geometries of transistors 121 and 122 are chosen such that their respective current-/voltage characteristics are symmetrical and that transistors 121 and 122 mirror transistors 233 and 222 with the voltage at the source of FET 122 being equal to and follow the voltage at the source of FET 222. As a result, FET's 122 and 222 operate to provide a current mirror operation between $I_2$ and $I_3$ whereby any current in $I_2$ will induce a proportional current in $I_3$.

Let $I_3=nI_2$, substitute equation (2) into $I_1$:

$$I_2=nI_1=nm(\Delta V_{BE}/R_{231})$$

The current in $I_3$ passes through a resistor 110 and generates a voltage equal to $I_3R_{110}$ thereacross.

Since $I_3=nm(\Delta V_{BE}/R_{231})$, the voltage across resistor 110 is thus equal to $$nm*\Delta V_{BE}*(R_{110}/R_{231}).$$

Since the temperature dependencies of both $R_{110}$ and $R_{231}$ cancel each other in $R_{110}/R_{231}$, therefore the temperature coefficient of the voltage across resistor 110 is proportional to the temperature coefficient of $\Delta V_{BE}$.

Figure 4:
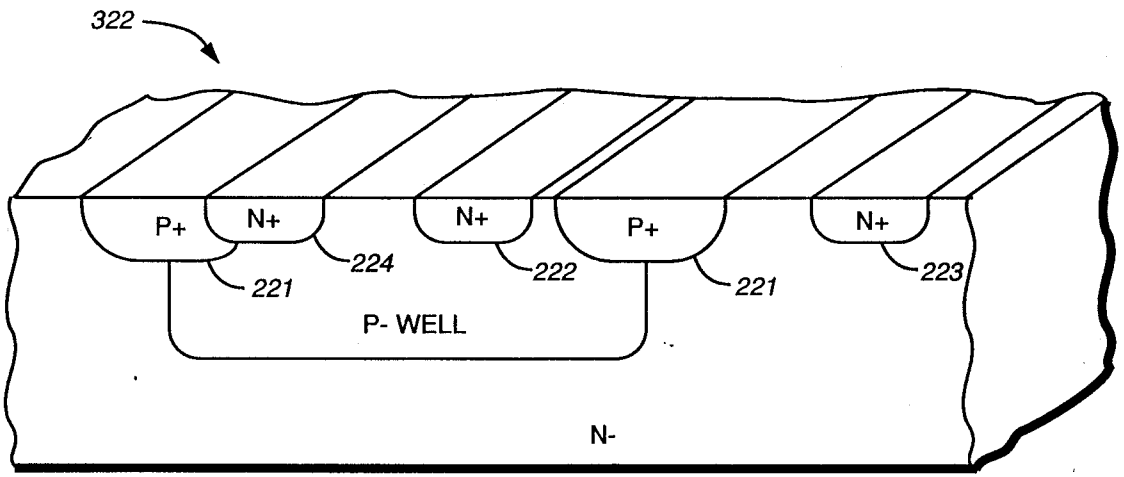
FIG. 4 is a cross sectional view of a bipolar transistor used in an embodiment of the present invention.

Resistor 110 is connected in series with a diode-connected NPN bipolar transistor 322. Transistor 322 is a lateral bipolar transistor fabricated in P-well technology. It is well known in the art that a bipolar transistor has a negative temperature coefficient (i.e., −2mV/°C.) associated with it. A cross-sectional view of the transistor 322 is shown in FIG. 4. The transistor comprises a base region 221 which is connected to the resistor 110, a collector region 222 which is also connected to the resistor 110, an emitter region 224 which is connected to the ground 4. The substrate of the transistor 322 is connected to $V_{DD}$ through region 223 as required by CMOS technology. With the above connection, the voltage across transistor 322 is equal to its base-to-emitter voltage, $V_{BE}$.

An output voltage $V_{REF}$, which is taken between power supply terminal 4 and the drain of FET 122, is:

$$\begin{aligned} V_{REF} &= V_{BE} + nm*\Delta V_{BE}*(R_{110}/R_{231}) \\ &= V_{BE} + K(\Delta V_{BE}) \end{aligned}$$

Thus, $V_{REF}$ gives a bandgap voltage reference. By adjusting the value of K, the temperature coefficient of $V_{REF}$ can be made to equal to zero.

In summary, the circuit in block 1 of FIG. 1 generates a current $I_l$ whose value is proportional to difference between respective base-emitter junction voltages of the bipolar transistors 232 and 233. The current $I_1$ induces a proportional current $I_2$ in block 2 through the current mirror operation between transistors 222 and 122. The current $I_2$ produces a voltage drop across resistor 110. This voltage drop is added to the base-emitter junction voltage of lateral bipolar transistor 322 to give the bandgap voltage reference.

When the power supply voltage between $V_{DD}$ 3 and ground 4 increases, the voltage at the drain of FET 212 with respect to $V_{DD}$ 3 will increase accordingly. When this voltage increases to a certain value, channel length modulation in FET 212 will cause an increase in the current flowing through FET 212 which will then have a finite output impedance characteristic. FET 211, however, is not so affected because its gate is connected to its drain. Therefore, when the power supply voltage between 3 and 4 increases, a mismatch will occur between FET 212 and FET 211 and will cause the ratio between $I_1$ and $I_2$ to increasingly deviate from their preferred values.

Similarly, when the voltage between $V_{DD}$ 3 and ground 4 increases, the voltage between the drain and source of FET 221, and the voltage between the drain and source of FET 122 will increase. When this voltage increases to a certain value, channel length modulation in FETs 221, 222 and 122 will cause an increase in the current flowing through FETs 221 and 122, and FETs 221 and 122 will then have a finite output impedance characteristic. However, the drain of FET 222 is not so affected because its gate and drain are commonly connected. Therefore, when the power supply voltage increases, an increasing mismatch will appear between FETs 221 and 222, and between FETs 122 and 222.

Figure 2:
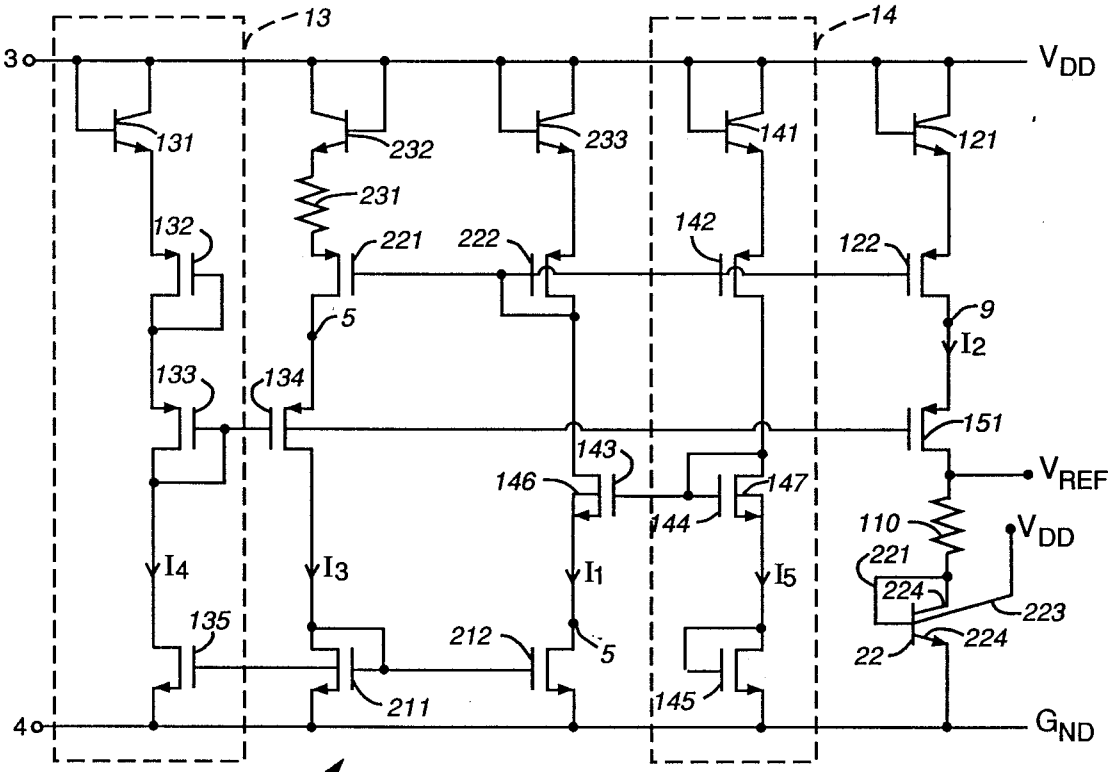
FIG. 2 is a schematic circuit diagram illustrating an embodiment of the present invention with provision to accommodate power supply variations.

FIG. 2 illustrates an embodiment of the present invention with the addition of circuits 13 and 14 to provide proper operation of the circuit 100 in the presence of power supply voltage variation between terminals 3 and 4.

Circuit 13 comprises an-N-channel FET 135, two P-channel FET 133 and 132, and an NPN bipolar junction transistor 131 which are coupled in series to form a current path I4. Transistors 131 and 132 of circuit 13 mirror transistors 233 and 222 of current path $I_1$. Circuit 13 is coupled to current path $I_3$ by a P-channel FET 134 which is inserted between the drains of FET's 221 and 211. FET 133 is also coupled to a P-channel FET 151 which is inserted between FET 122 and resistive element 110 in current path $I_2$. Circuit 13 sets a lower limit on the voltage at the drain of FET 221 in $I_1$ and at the drain of FET 122 in $I_2$.

Circuit 14 comprises an NPN bipolar junction transistor 141, a P-channel FET 142, an N-channel FET 144 and an N-channel FET 145 which are coupled in series to form a current path $I_5$. Transistor 145 of circuit 14 mirrors transistor 211 of current path $I_3$. The circuit 14 is coupled to $I_1$ by an N-channel FET 143 whose drain is connected to the drain of FET 222 and whose source is connected to the drain of FET 212. The well 146 of FET 143 and the well 147 of FET 144 are respectively connected to their sources. Circuit 14 sets an upper limit on the voltage at the drain of FET 212 in $I_1$.

The voltage at the drain of FET 221 in I2 is:

$$V_{DD}-V_{BE(131)}-V_{GS(133)}-V_{GS(133)}+V_{GS(134)}$$

Since the gates of FET's 133 and 134 are connected together, the lower limit of the voltage at the source of FET 134 will be clamped by the voltage at the source at FET 133. However, since transistors 131 and 132 mirror transistors 233 and 222, the voltage at the drain of FET 132 is therefore clamped to the voltage at the drain of FET 222.

The voltage at the drain of FET 122 in $I_2$ is:

$$V_{DD}-V_{BE(131)}-V_{GS(132)}-V_{GS(133)}V_{GS(151)}$$

Since the gates of FET's 133 and 151 are connected together, the lower limit voltage at the source of FET 151 will be clamped by the voltage at the source at FET 133. However, since transistors 131 and 132 mirror transistors 233 and 222, the voltage at the drain of FET 151 is therefore clamped to the voltage to the drain of FET 222.

The voltage at the drain of FET 212 is:

$$V_{GS(145)}+V_{GS(144)}-V_{GS(143)}$$

Since the gates FETs 144 and 143 are connected together, the upper limit of voltage at the drain of FET 212 will be clamped by the voltage at the drain of FET 145. But since transistor 145 mirrors transistor 211, the upper limit of voltage at the drain of FET 212 is therefore clamped to the voltage at the drain of FET 211.

The following parameters are given as an example for implementing the preferred embodiment:

The ratio between the respective emitter areas, A, of bipolar junction transistors 131, 232, 233, 141 and 121 is:

$$A_{131}:A_{232}:A_{233}:A_{144}:A_{121}=1:100:1:1:2$$

In current path $I_1$:

$$FET_{222}\left(\frac{W}{L}\right)_p=\frac{50}{20}$$

$$FET_{143}\left(\frac{W}{L}\right)_n=\frac{15}{20}$$

$$FET_{212}\left(\frac{W}{L}\right)_n=\frac{15}{20}$$

In current path $I_2$:

$$FET_{122}\left(\frac{W}{L}\right)_p=\frac{100}{20}$$

$$FET_{151}\left(\frac{W}{L}\right)_p=\frac{100}{20}$$

In current path $I_3$:

$$FET_{221}\left(\frac{W}{L}\right)_p=\frac{50}{20}$$

$$FET_{134}\left(\frac{W}{L}\right)_p=\frac{50}{20}$$

$$FET_{211}\left(\frac{W}{L}\right)_n=\frac{15}{20}$$

In current path $I_4$:

$$FET_{132}\left(\frac{W}{L}\right)_p=\frac{25}{20}$$

$$FET_{133}\left(\frac{W}{L}\right)_p=\frac{25}{20}$$

$$FET_{135}\left(\frac{W}{L}\right)_n=\frac{7.5}{20}$$

In current path $I_5$:

$$FET_{142}\left(\frac{W}{L}\right)_p=\frac{25}{20}$$

-continued $$FET_{144}\left(\frac{W}{L}\right)_p = \frac{7.5}{20}$$

$$FET_{145}\left(\frac{W}{L}\right)_n = \frac{7.5}{20}$$

$$R_{231} = 12\text{k ohm}$$

$$R_{110} = 33\text{k ohm}$$

In operation:

$$V_{BE(232)} = V_T \ln[I_3/I_{s(232)}]$$

$$V_{BE(233)} = V_T \ln[I_1/I_{s(233)}]$$

Where $V_T$ = thermal voltage, and $I_s$ = saturation current which is proportional to the emitter area of a transistor.

$$V_{BE(233)} - V_{BE(232)} = V_T \ln[(I_1/I_{s(233)})/(I_3/I_{s(232)})]$$

Because $FET_{211}\left(\frac{W}{L}\right) = FET_{212}\left(\frac{W}{L}\right)$, therefore $I_1 = I_3$ $$\begin{aligned} \therefore \Delta V_{BE} &= V_T \ln[I_{s(232)}/I_{s(233)}] = V_T \ln[A_{(232)}/A_{(233)}] \\ &= V_T \ln 100 = 120 \text{ mv} \\ \therefore I_3 &= (\Delta V_{BE}/R_{231}) = 10\ \mu A \end{aligned}$$

With the given values of the transistors in the exemplary implementation, a current equal to $2I_1$ is mirrored to $I_2$, Therefore:

$$\begin{aligned} V_{REF} &= V_{BE} + 2I_1R_{110} \\ &= V_{BE} + 2(\Delta V_{BE}/R_{231})R_{110} \\ &= V_{BE} + [(2R_{110}/R_{231})(\Delta V_{BE})] \end{aligned}$$

To find the proper weighting factors for $V_{BE}$ and $\Delta V_{BE}$ respectively so that $V_{REF}$ has zero temperature coefficient, let $$dV_{REF}/dt = 0$$

Since $$V_{REF} = V_{BE} + [(2R_{110}/R_{231})(\Delta V_{BE})]$$

therefore $$d[2(R_{110}/R_{231})\Delta V_{BE}]/dT] + dV_{BE}/dt = 0$$

The temperature coefficient of lateral bipolar transistor 22 at room temperature (25° C.) is −2.2 mv/°C.

The temperature coefficient of $\Delta V_{BE}$ at room temperature is 0.4 mv/°C., therefore, $$2(R_{110}/R_{231})(0.4) = 2.2 \text{ mv./°C. and } R_2/R_1 = 2.75.$$

At 25° C. temperature with $(R_{110}/R_{231}) = 2.7$:

$$\begin{aligned} V_{REF} &= V_{BE} + 2(R_2/R_1)(\Delta V_{BE}) \\ &= .62 + 2(2.7)(120 \text{ mv}) \\ &= 1.28 \text{ v} \end{aligned}$$

Figure 3:
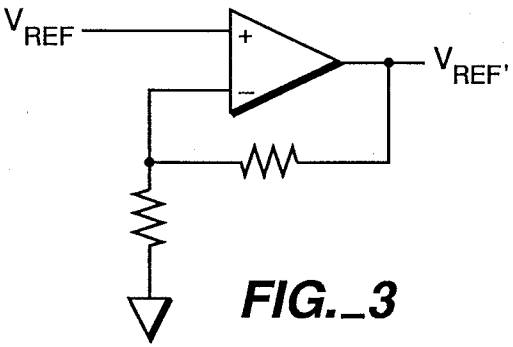
FIG. 3 illustrates how the level of a bandgap reference output can optionally be shifted.

It can be see from the above description and the figures that the voltage reference is provided without the use of an operational amplifier. If, on the other hand, a different reference voltage is needed (for example, $V'_{REF} = 2.16$ volt), then $V_{REF}$ is fed to a non-inverting amplifier as shown in FIG. 3. But such level shifting and the corresponding use of the operational amplifier are optional.

The foregoing disclosure and discussion of the present invention provides a broad teaching of the present invention. It is understood that many modifications and variations thereof will be readily apparent to persons of average skill in the art. One such modification is the substitution of PNP for NPN bipolar transistors, P-channel for N-channel transistors and N-channel for P-channels transistors such that the present invention operating from reversed polarity source potentials. It is therefore to be understood that, within the scope of the appended claims, the invention may be practiced otherwise than specifically described.

I claim:

1. A circuit for providing a bandgap voltage reference, comprising:

a first current path;

a second current path;

a third current path;

first current mirror means coupled to said first and second current paths for establishing a ratio between respective current values thereof;

second current mirror means coupled to said first, second and third current paths including means for defining equal voltage potentials among a first node in said first current path and a second node in said second current path and a third node in said third current path, and means for providing a current mirror operation between the second and third current paths to establish a ratio between respective current values thereof;

means coupled to said first and second current paths for defining a first current with a first temperature coefficient in the first current path;

means coupled to said third current path for providing a first voltage from current in said third current path;

means coupled to said third current path for providing a second voltage, the third current path having a second temperature coefficient associated with it, wherein said first and second temperature coefficients have opposite signs; and means for generating a weighted sum of said first and second voltages.

2. A circuit as in claim 1, wherein the first current mirror means comprises a first field effect transistor of a first type connected in the first current path and a second field effect transistor of the first type connected in the second current path.

3. A circuit as in claim 2, wherein said means for defining said first current comprises a first bipolar transistor and a resistor, in said first current path, and a second bipolar junction transistor, in said second current path, said first bipolar transistor being connected in series with said resistor.

4. A circuit as in claim 3, wherein said second current mirror means comprises a third field effect transistor of a second type connected in said first current path, a fourth field effect transistor of said second connected type in said second current path, a fifth field effect transistor of said second type in said third current path, said fifth field effect transistor and said third bipolar transistors being connected in series.

5. The circuit as in claim 4, wherein each of the first, second, third, fourth and the fifth transistors has a source terminal, a gate terminal and a drain terminal, wherein the gate terminals of both the first and the second transistors are connected to the drain terminal of the first transistor and wherein the gate terminals of both the third and the fourth transistors are connected to the drain terminal of the fourth transistors.

6. The circuit of claim 3, wherein the first type is N-channel type field effect transistors, wherein the second type is P-channel type field effect transistor.

7. A circuit as in claim 1, wherein said means for providing the first voltage comprises a resistor and said means for providing the second voltage comprises a transistor.

8. A circuit as in claim 7, wherein said transistor is a lateral bipolar transistor.

9. A circuit as in claim 8, wherein said lateral bipolar transistor is a NPN lateral bipolar transistor.

10. A method for providing a substantially temperature-independent voltage reference, comprising the steps of:

generating a first current with a first temperature coefficient;

using current mirror operation to induce a proportional second current from said first current;

generating a proportional first voltage from the second current;

generating a second voltage with a second temperature coefficient where the first and second coefficients have opposite signs; and generating a weighted sum of the second voltage and the first voltage.

11. A method as in claim 10, wherein said first temperature coefficient is proportional to the temperature coefficient of a difference between respective base-to-emitter junctions of two bipolar transistors, and wherein said second temperature coefficient is proportional to the temperature coefficient of a base-to-emitter junction of a bipolar transistor.

12. A circuit for providing a substantially temperature-independent voltage reference, comprising:

a first current source generating a first current and having a first temperature coefficient;

a second current source;

first current mirror means for providing a current mirror operation between said first current source and said second current source to induce said second current source to generate a second current proportional to said first current;

first voltage generation means coupled to said second current source for generating a first voltage from said second current;

second voltage generation means coupled to said first voltage generation means for generating a second voltage and having a second temperature coefficient, said first and second temperature coefficients having opposite signs; and, voltage referencing mean for providing a weighted sum of said second voltage and said first voltage.

13. A circuit as in claim 12, wherein said first current source comprises:

a first current path having a first current value;

a second current path having a second current value;

a first means coupled to said first and second current paths for defining a ratio between respective first and second current values thereof;

a second means coupled to said first and second current paths for defining an equal voltage potential between a first node in said first current path and a second node in said second current path; and, a third means coupled to said first and second nodes for defining said first current.

14. A circuit as in claim 13, wherein said first means for defining a ratio comprises first and second transistors interconnected so as to provide a current mirror operation between said first and second current paths.

15. A circuit as in claim 14, wherein said second means for defining an equal voltage comprises third and fourth transistors interconnected so as to provide a current mirror operation between said first and second current paths.

16. A circuit as in claim 15, wherein said third means for defining the first current comprises a first bipolar junction transistor and a resistor, in said first current path, and a second bipolar junction transistor in said second current path, said first bipolar junction transistor and said resistor being connected in series.

17. A circuit as in claim 16, wherein said first resistor is coupled to said first node.

18. A circuit as in claim 17, wherein said second voltage generation means comprises a lateral bipolar junction transistor.

19. A circuit as in claim 18, wherein said first voltage generation means comprises a resistor.

20. A circuit as in claim 12, wherein said second voltage generation means comprises a lateral bipolar junction transistor.

21. A circuit as in claim 12, wherein said first voltage generation means comprises a resistor.

22. A circuit as in claim 12, wherein said voltage referencing means comprises a node interconnected to said first voltage generation means and said second voltage generation means.

23. A circuit as in claim 16, wherein said first and second transistors comprises field effect transistors of a first type and said third and fourth transistors are field effect transistors of a second type.

24. A circuit as in claim 23, wherein said first type of field effect transistor comprises N-channel type field effect transistors and said second type of field effect transistors comprising P-channel type field effect transistors.

25. A circuit as in claim 33, wherein said first and third transistors and said second and fourth are respective pairs of CMOS transistors.

26. A circuit as in claim 16, wherein said first current is proportional to a difference between respective junction voltages of said first and second bipolar transistors.

* * * * *